US011578945B1

(12) United States Patent
Rosenbaum

(10) Patent No.: US 11,578,945 B1
(45) Date of Patent: Feb. 14, 2023

(54) SWITCH ACTUATOR

(71) Applicant: Milspec Enterprises, LLC, Panorama City, CA (US)

(72) Inventor: Yosef Rosenbaum, Los Angeles, CA (US)

(73) Assignee: Milspec Enterprises, LLC, Panorama City, CA (US)

( * ) Notice: Subject to any disclaimer, the term of this patent is extended or adjusted under 35 U.S.C. 154(b) by 0 days.

(21) Appl. No.: 17/889,354

(22) Filed: Aug. 16, 2022

Related U.S. Application Data

(60) Provisional application No. 63/234,055, filed on Aug. 17, 2021.

(51) Int. Cl.
*F41G 1/35* (2006.01)

(52) U.S. Cl.
CPC ..... *F41G 1/35* (2013.01)

(58) Field of Classification Search
CPC ..... F41G 1/35
See application file for complete search history.

(56) References Cited

U.S. PATENT DOCUMENTS 4,856,218 A 8/1989 Reynolds, Jr.
7,117,624 B2 10/2006 Kim
7,188,978 B2 3/2007 Sharrah
8,371,729 B2 2/2013 Sharrah et al.
8,944,626 B2 2/2015 Matthews et al.
9,435,522 B2 9/2016 Galli et al.
9,551,550 B2 1/2017 Wells
D885,510 S 5/2020 Wells et al.
10,948,266 B2 3/2021 Wells et al.
2015/0124436 A1 5/2015 Galli et al.
2015/0276347 A1* 10/2015 Sharrah ..... F41G 1/35 42/117
2018/0283670 A1 10/2018 Galli et al.

* cited by examiner

*Primary Examiner* — Thomas M Sember

(74) *Attorney, Agent, or Firm* — Asgaard Patent Services, LLC; F. Wayne Thompson, Jr.

(57) ABSTRACT

Disclosed are implementations of a switch actuator that can be attached to a switch device of a weapon mounted light and used, in conjunction with the switch device, to selectively actuate a light emitter of the weapon mounted light. An example switch actuator comprises: a base configured for attachment to the switch device; an actuator paddle offset from and positioned above the base; and an actuator arm connecting the actuator paddle to the base. The switch actuator is used to forwardly urge the switch device to place the switch device in a momentary ON position, and rotatably urge the switch device to place the switch device in a constant ON or OFF position.

10 Claims, 13 Drawing Sheets

SWITCH ACTUATOR

CROSS REFERENCE TO RELATED APPLICATION

This application claims the benefit of U.S. Provisional Application Ser. No. 63/234,055, filed on Aug. 17, 2021, the entirety of which is incorporated herein by reference.

TECHNICAL FIELD

This disclosure relates to implementations of a switch actuator for a weapon mounted light.

BACKGROUND

A weapon mounted light is a flashlight that can be attached to a firearm, leaving the operator free to use both hands to control the firearm. Weapon mounted lights are used for illumination, through some are equipped with a laser diode suitable for aiming. Some weapon mounted light are configured for attachment to an accessory rail on the dustcover of a handgun frame, below the barrel. This positions the weapon mounted light to be substantially parallel with the longitudinal axis of the barrel.

Weapon mounted lights configured for attachment to a handgun frame typically include one or more actuators, often referred to as paddles, to operate (i.e., turn ON and OFF) the weapon mounted light. These actuators, or paddles, are often positioned to straddle the trigger guard of the handgun and thereby facilitate operation of the weapon mounted light. However, some operators find that they must compromise their grip in order to manipulate the appropriate actuator (i.e., the actuator closest to the thumb of their nondominant hand). Ideally, the contact surface of the paddle would be positioned closer to the thumb.

Accordingly, it can be seen that a need exists for the switch actuator disclosed herein. It is to the provision of a switch actuator configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed are implementations of a switch actuator that can be attached to a switch device of a weapon mounted light and used, in conjunction with the switch device, to selectively actuate a light emitter of the weapon mounted light.

An example switch actuator comprises: a base configured for attachment to the switch device; an actuator paddle offset from and positioned above the base; and an actuator arm connecting the actuator paddle to the base. The switch actuator is used to forwardly urge the switch device to place the switch device in a momentary ON position, and rotatably urge the switch device to place the switch device in a constant ON or OFF position.

Another example switch actuator comprises: a base configured for attachment to the switch device, an actuator paddle offset from and positioned above the base; and an actuator arm connecting the actuator paddle to the base. The actuator paddle comprises a horizontally disposed activation surface used to rotatably urge the switch device to place the switch device in a constant ON position.

BRIEF DESCRIPTION OF THE DRAWINGS

Like reference numerals refer to corresponding parts throughout the several views of the drawings.

DETAILED DESCRIPTION

Figure 1:
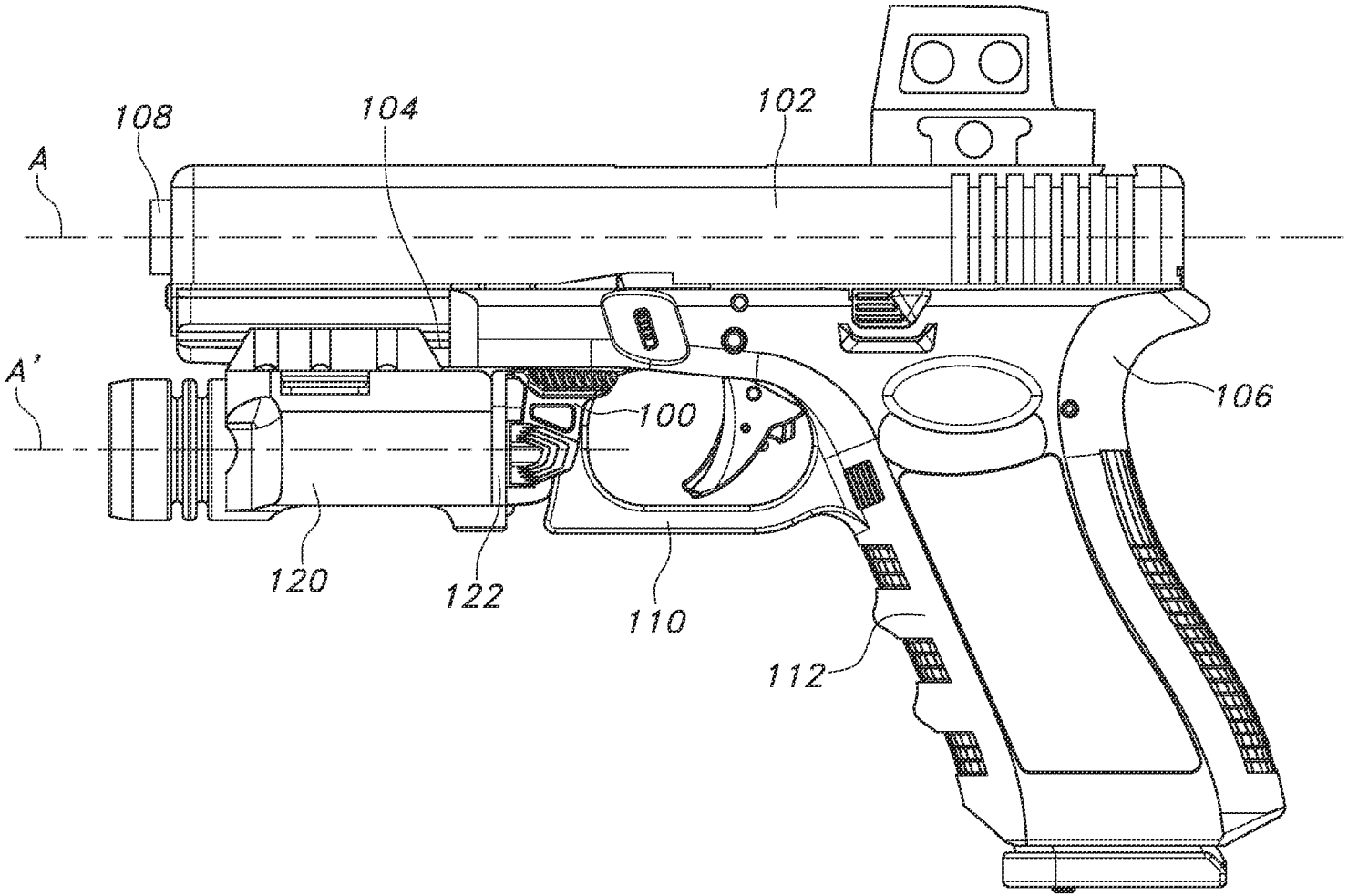
FIG. 1 is a side elevational view of a handgun that has a weapon mounted light attached to the accessory rail of the frame, an example switch actuator according to the principles of the present discloser is attached to the switch device of the weapon mounted light.

FIG. 1 shows an example firearm, specifically a pistol 102, that has a weapon mounted light 120 attached to the accessory rail 104 of the frame 106. The accessory rail 104 is positioned below the barrel 108 and forward of the trigger guard 110. An example switch actuator 100, according to the principles of the present disclosure, is attached to a switch device 122 of the weapon mounted light 120. The switch actuator 100 can be used, in conjunction with the switch device 122, to turn the weapon mounted light 120 ON and OFF.

As used herein, "longitudinal" describes a direction along or parallel to the longitudinal axis A of the barrel 108, or along or parallel to the longitudinal axis A' of the weapon mounted light 120 which is parallel to the axis A of the barrel 108 when the weapon mounted light 120 is attached to the frame 106; and "transverse" describes a horizontal direction perpendicular to the axis A of the barrel 108, or the axis A' of the weapon mounted light 120.

Figure 2A:
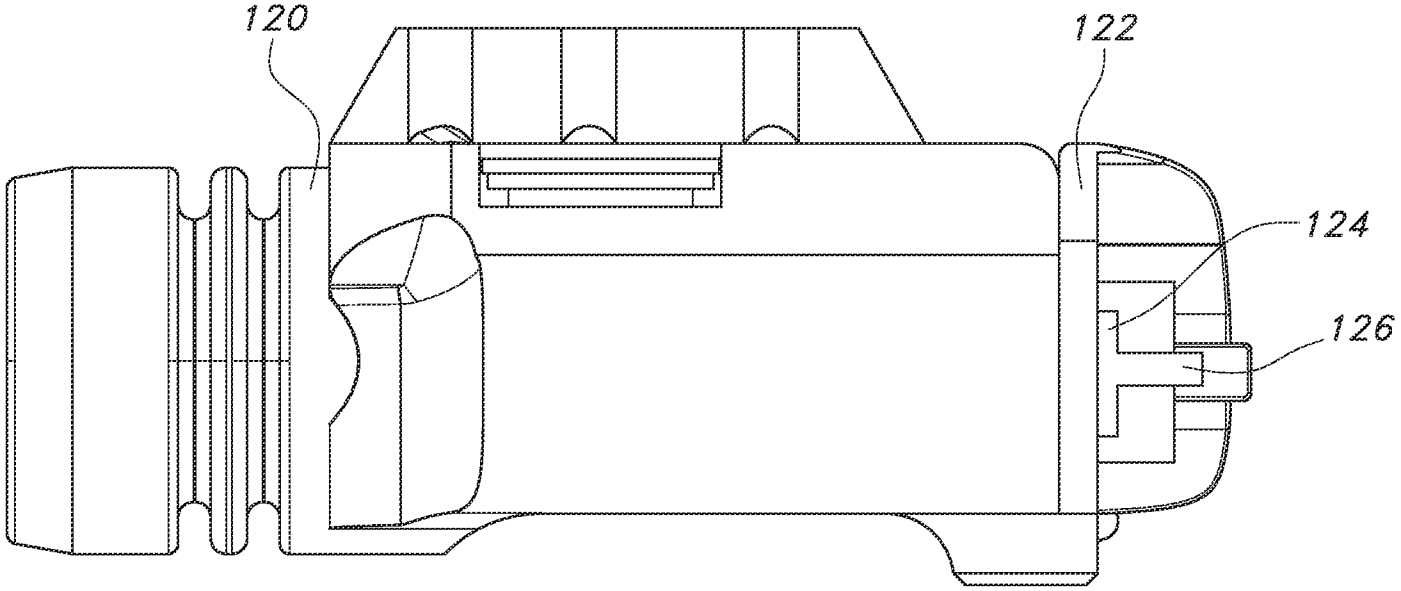
FIG. 2A is a side elevational view of the weapon mounted light shown in FIG. 1, wherein the switch actuator has been removed to expose the actuator arm of the switch device.
Figure 2B:
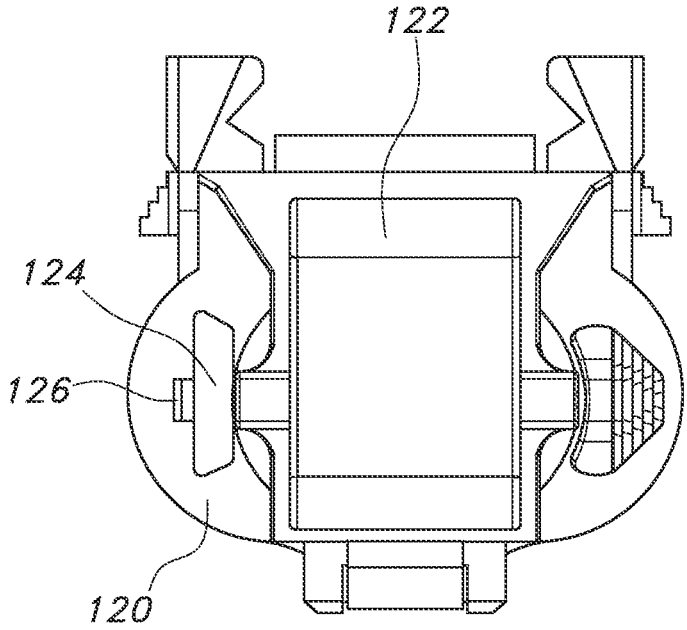
FIG. 2B is a back side elevational view of the weapon mounted light shown in FIG. 2.
Figure 3:
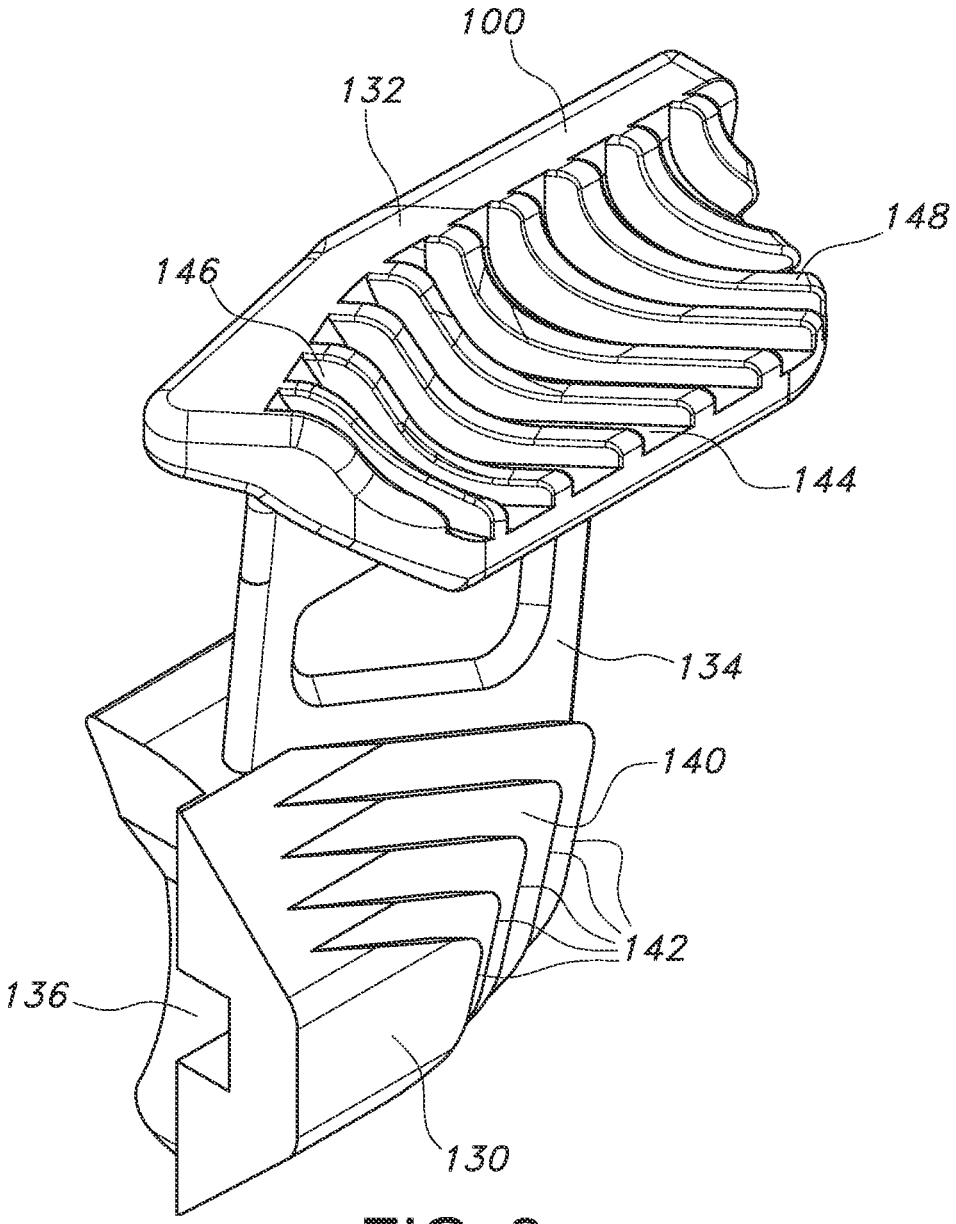
FIG. 3 is an isometric view of the switch actuator shown in FIG. 1.
Figure 4:
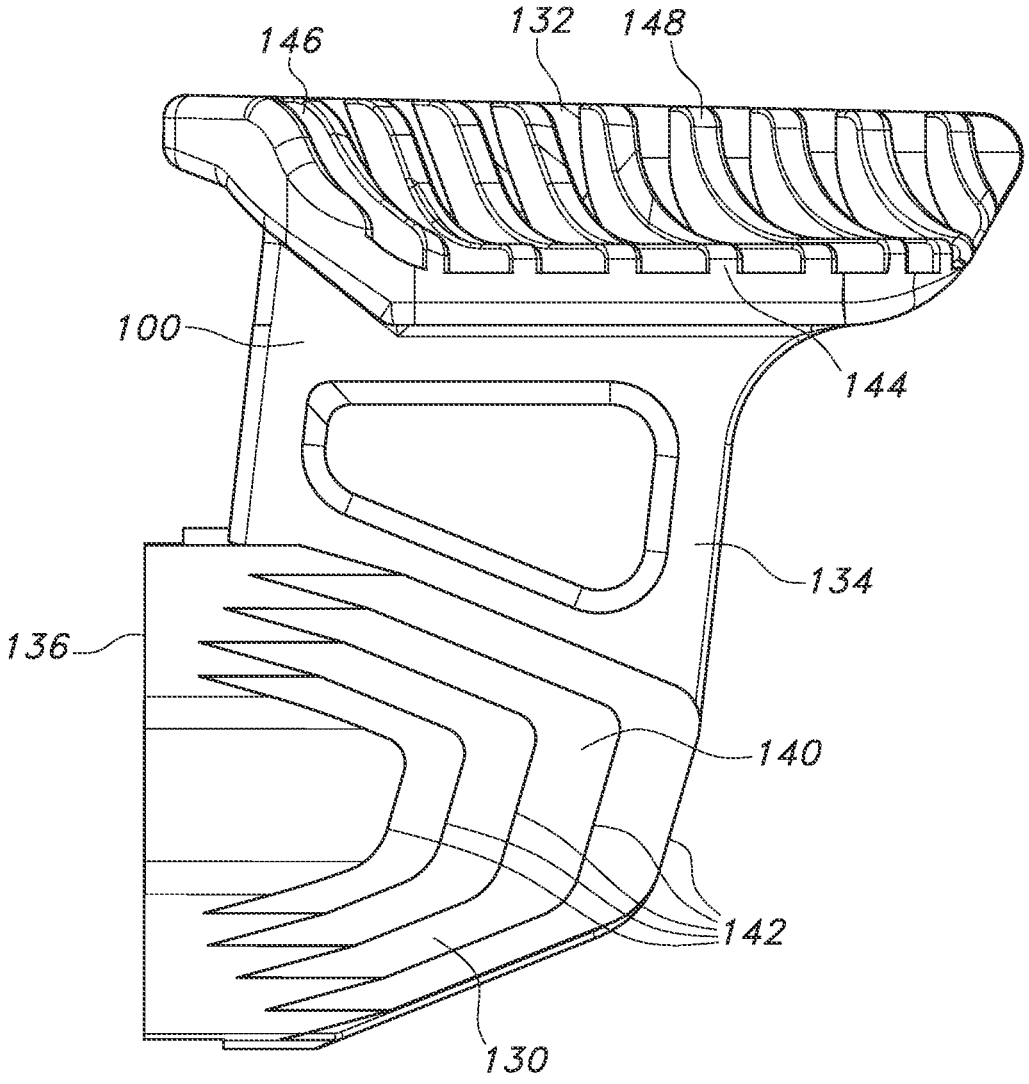
FIG. 4 is a left side elevational view of the switch actuator shown in FIG. 4.
Figure 5:
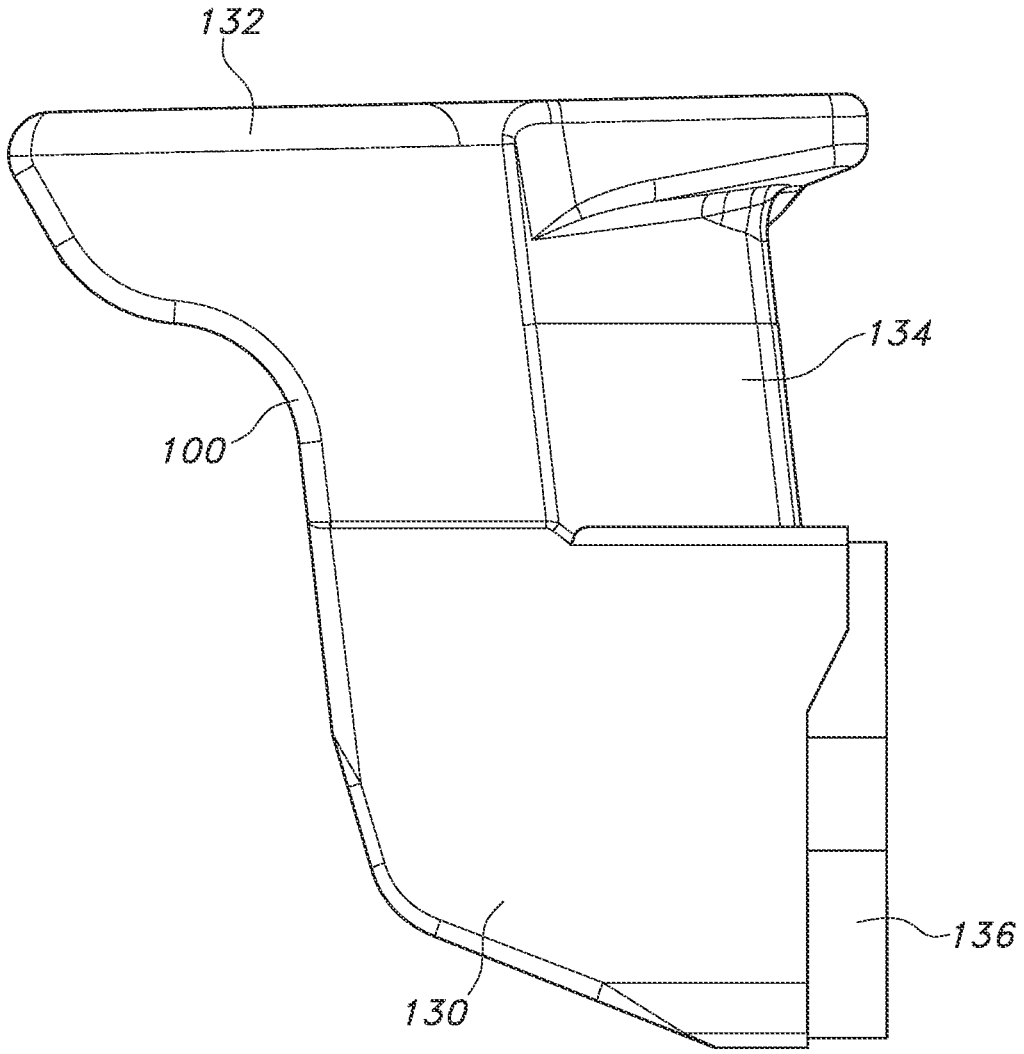
FIG. 5 is a right side elevational view of the switch actuator shown in FIG. 4.
Figure 6:
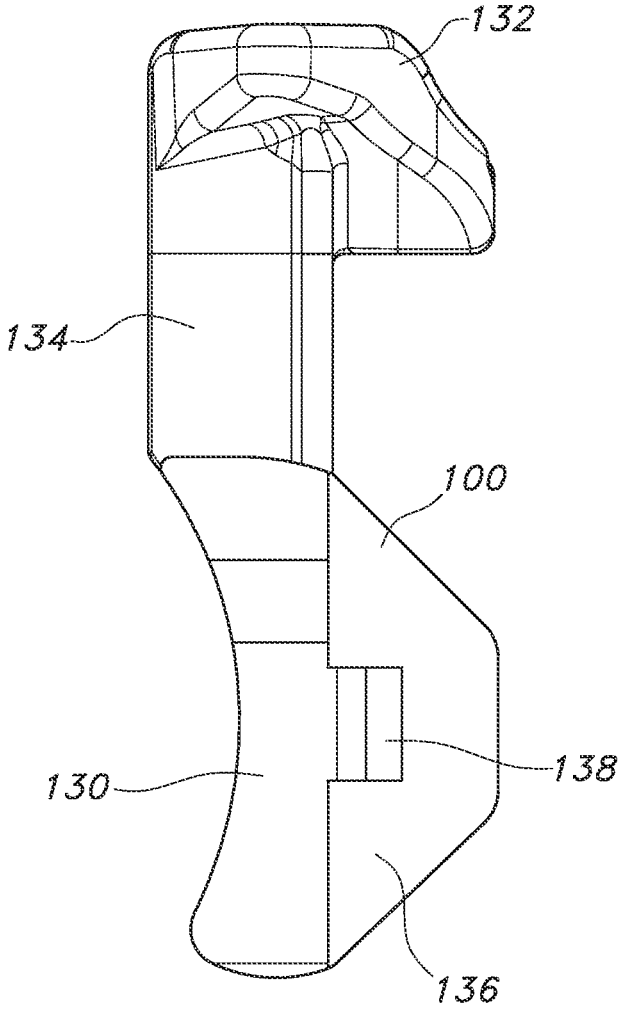
FIG. 6 is a front side elevational view of the switch actuator shown in FIG. 4.
Figure 7:
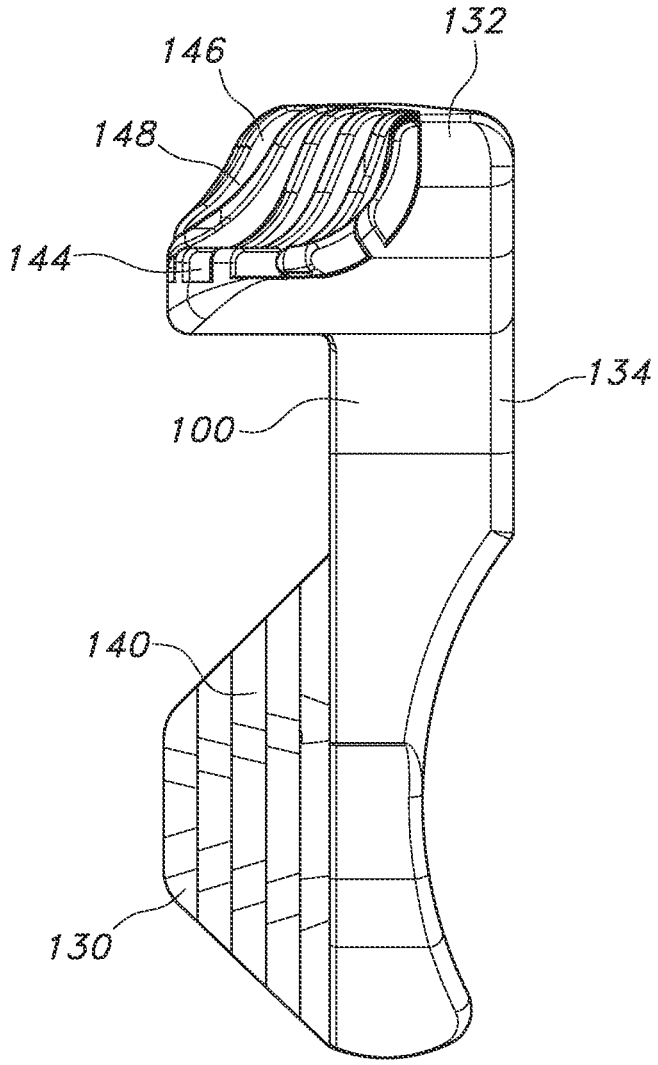
FIG. 7 is a back side elevational view of the switch actuator shown in FIG. 4.
Figure 8:
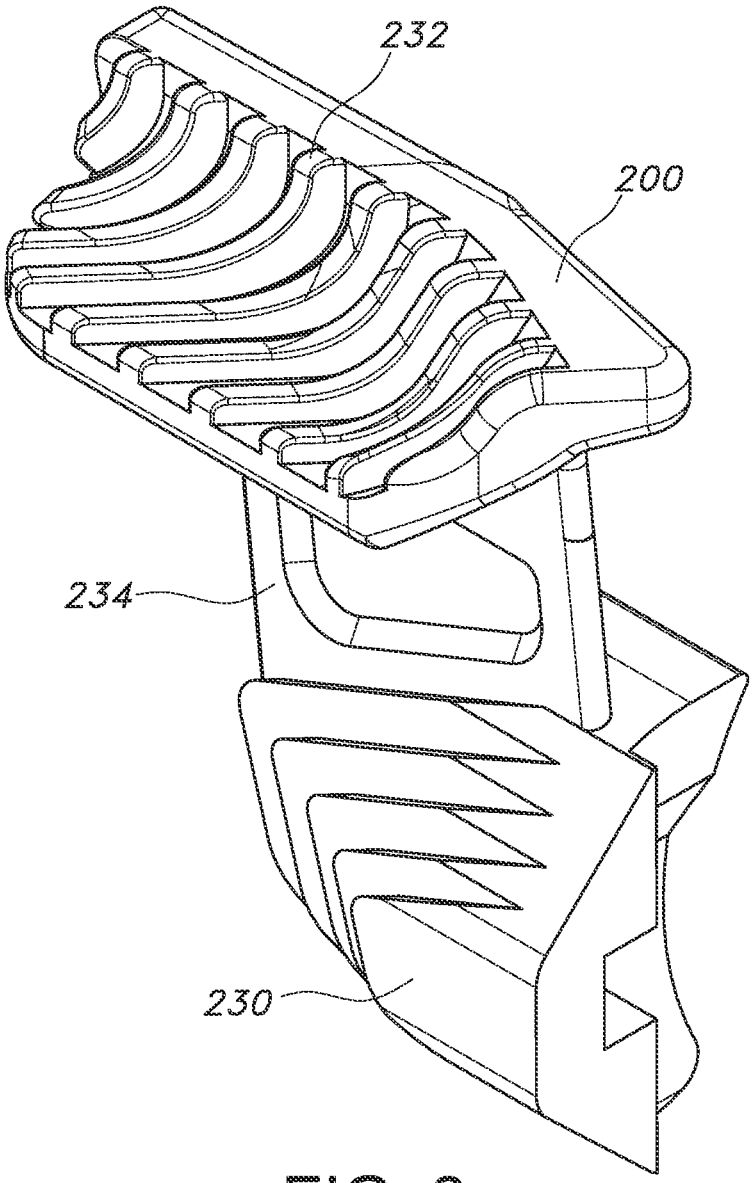
FIG. 8 is an isometric view of another example switch actuator according to the principles of the present disclosure.
Figure 9:
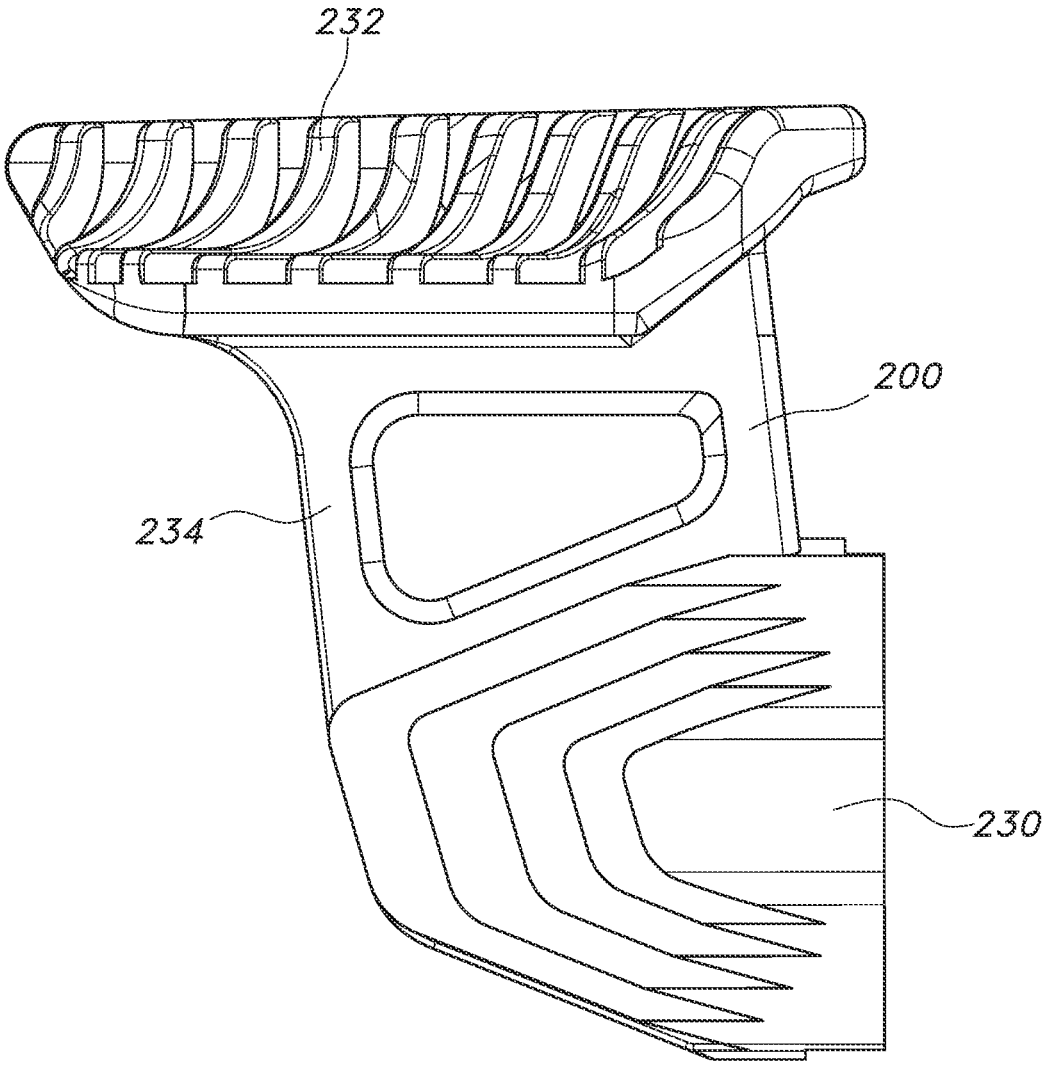
FIG. 9 is a right side elevational view of the switch actuator shown in FIG. 8.
Figure 10:
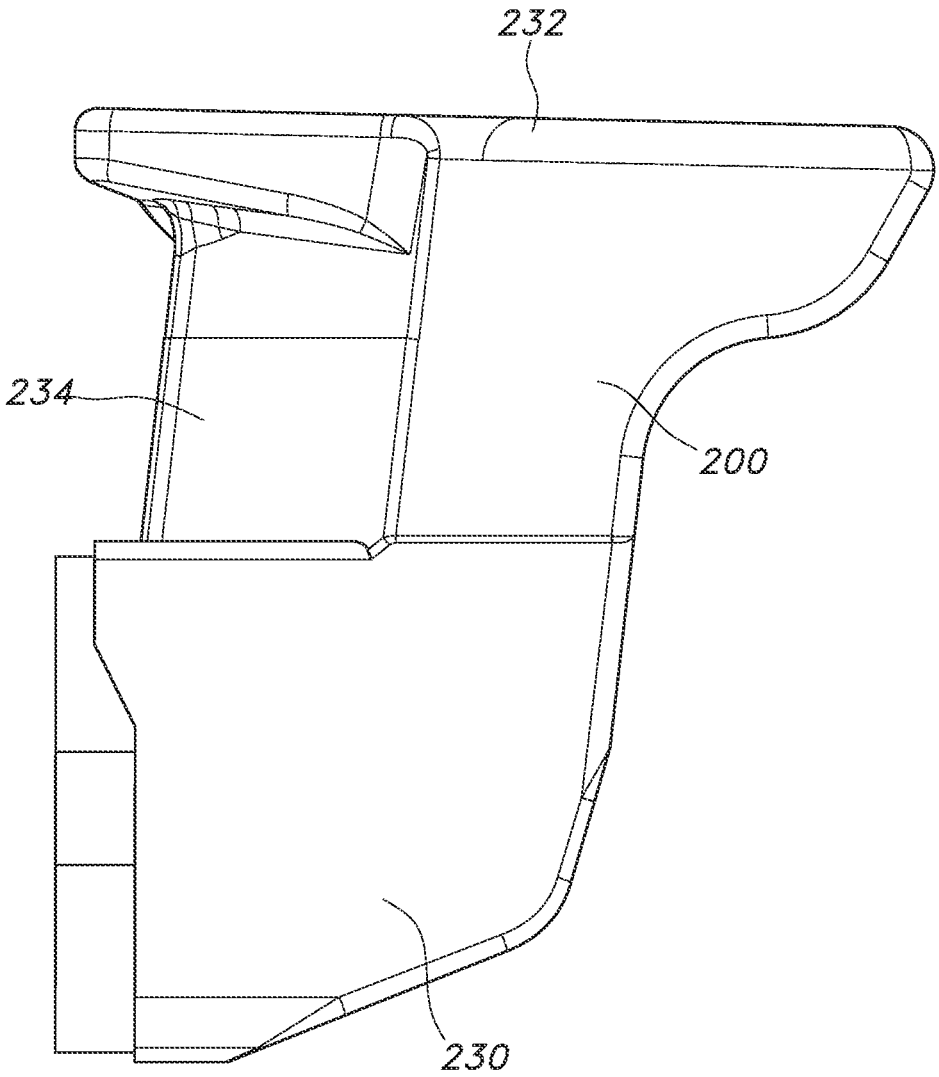
FIG. 10 is a left side elevational view of the switch actuator shown in FIG. 8.
Figure 11:
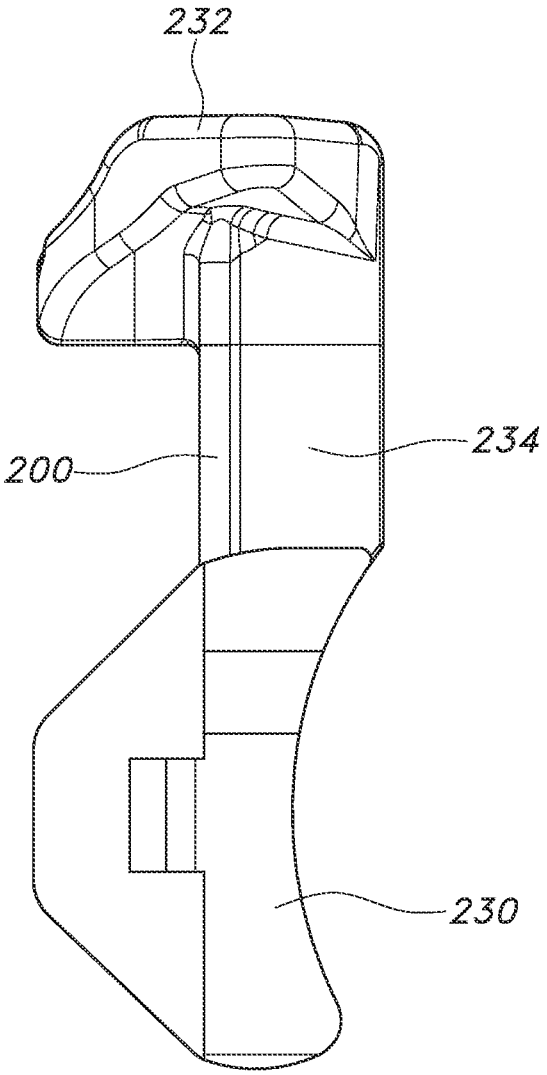
FIG. 11 is a front side elevational view of the switch actuator shown in FIG. 8.
Figure 12:
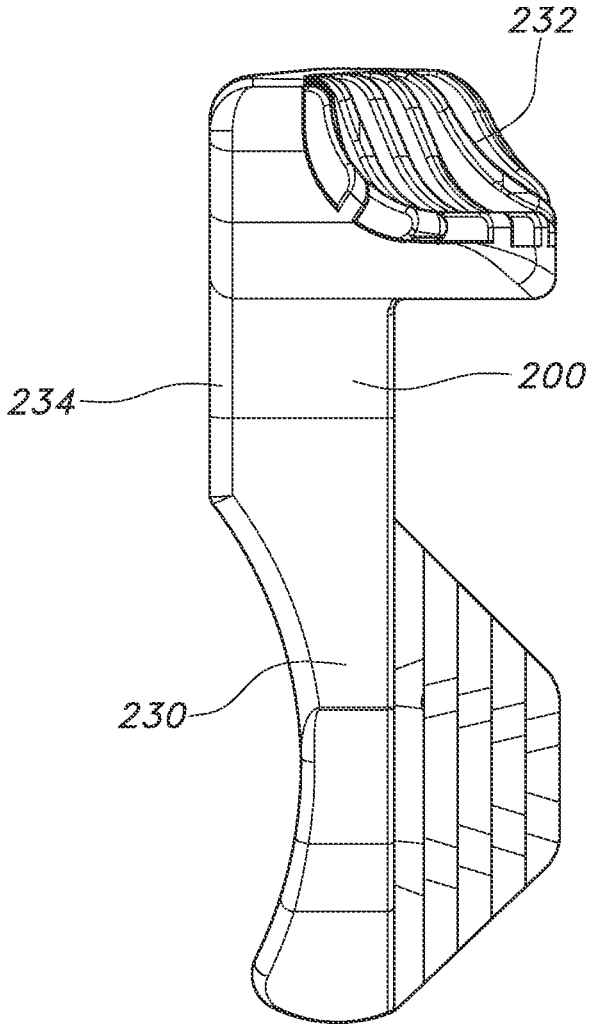
FIG. 12 is a back side elevational view of the switch actuator shown in FIG. 8.

FIGS. 2A and 2B show the weapon mounted light 120 seen in FIG. 1. The switch device 122 of the weapon mounted light 120 comprises a switch actuator arm 124 with a rearwardly extending tab 126. Further details of an exemplary switch device are described in U.S. Pat. No. 7,117,624, entitled "ACCESSORY DEVICES FOR FIREARMS", which is expressly incorporated herein by reference.

As shown in FIGS. 3-7, the example switch actuator 100 comprises a base 130 configured for attachment to the switch device 122 of the weapon mounted light 120 and an actuator paddle 132 used to actuate the weapon mounted light 120. The actuator paddle 132 is offset from and positioned above the base 130 by an actuator arm 134 to allow a user to forwardly urge, or cause rotation of, the switch device 122 by pushing on the actuator paddle 132 using their thumb (see, e.g., FIG. 1). In this way, the switch device 122 can be actuated from an OFF position to either a momentary ON position by forwardly urging the switch device 100, or a constant ON position by downwardly rotating the switch device 100.

The base 130 of the switch actuator 100 is configured for attachment to the switch device 122 of the weapon mounted light 120. More specifically, a front end 136 of the base 130 is configured to interface with an end of the switch actuator arm 124. The interface 136 defined by the base 130 includes an opening 138 configured to receive a tab 126 extending from the switch actuator arm 124 (see, e.g., FIG. 6). The opening 138 in the front end 136 of the base 130 is friction-fit onto the tab 126. Although, in some implementations, an epoxy or other adhesive is used to secure the base 130 of the paddle actuator 100 to the switch actuator arm 124 of the switch device 122.

The base 130 of the switch actuator 100 can also be used to actuate the switch device 122 of the weapon mounted light 120. Specifically, the base 130 can be pushed down to cause rotation of the switch device 122 and thereby activate the constant ON function of the weapon mounted light 120. Also, the base 130 can be pushed forward to activate the momentary ON function of the weapon mounted light 120. The base 130 includes a stepped or terraced surface 140 on a lateral side thereof. The steps 140 on the lateral side of the base 130 are configured to provide a textured surface that aids the user when pressing on the base 130 to actuate the switch device 122 of the weapon mounted light 120. In some implementations, one or more edges 142 of each step, or terrace, are beveled.

The actuator paddle 132 of the switch actuator 100 comprises a horizontally disposed activation surface 144 and an upwards swept ledge 146. The horizontal activation surface 144 can be pushed down to cause rotation of the switch device 122 and thereby activate the constant ON function of the weapon mounted light 120. The upwards swept ledge 146 serves as an activation surface and can be pushed forward to activate the momentary ON function of the weapon mounted light 120. The horizontally disposed activation surface 144 and upwards swept ledge 146 include a plurality of angled ribs 148 thereon. However, in some implementations, the angled ribs 148 could be replaced with another surface preparation and/or texture that provides a suitable gripping surface.

The actuator arm 134 of the switch actuator 100 provides leverage that makes is easier to operate the weapon mounted light 120 while it is attached to the pistol 102. The actuator arm 134 positions the actuator paddle 132 above the base 130 of the switch actuator, adjacent the frame 106 and trigger guard 110 of the pistol 102. In this way, the actuator paddle 132 is within reach of the user's thumb without the user removing their hand from the firing position on the grip 112 of the frame 106. In this context, being "adjacent to the grip" means being within reach of the user's thumb while the user's hand is in the firing position on the grip 112 of the pistol's frame 106.

The actuator paddle 132 of the switch actuator 100 is accessible from what would be the left-hand lateral side of the pistol 102 shown in FIG. 1. As is shown in FIGS. 8-12, an alternate embodiment of the switch actuator 200 can be configured for attachment to the switch device 122 of the weapon mounted light 200 and provide an actuator paddle 232 that is accessible from what would be the right-hand lateral side of the pistol 102.

FIGS. 8-12 illustrate another example switch actuator 200 according to the principles of the present disclosure. The switch actuator 200 is similar to the switch actuator 100 discussed above, and comprises a base 230 configured for attachment to the switch device 122 of the weapon mounted light 120 and an actuator paddle 232 for actuating the weapon mounted light 120. The actuator paddle 232 is offset from and positioned above the base 230 by an actuator arm 234 to allow a user to forwardly urge, or cause rotation of, the switch device 122 by pushing on the actuator paddle 232 using their thumb. In this way, the switch device 122 can be actuated from an OFF position to either a momentary ON position by forwardly urging the switch device 200, or a constant ON position by downwardly rotating the switch device 200.

A switch actuator 100, 200 can be 3D printed or injection molded. Each switch actuator 100, 200 is made of nylon, though other suitable plastics could be used. The base (130, 230), actuator paddle (132, 232), and actuator arm (134,234) are a unitary piece.

While a Surefire® model X300® weapon light is shown in FIGS. 1, 2A and 2B, a switch actuator 100, 200 could be adapted to work with other weapon mounted lights currently known or developed in the future.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A switch actuator used in conjunction with a switch device of a weapon mounted light to selectively actuate a light emitter of the weapon mounted light, the switch actuator comprising:

a base configured for attachment to the switch device;

an actuator paddle offset from and positioned above the base; and an actuator arm connecting the actuator paddle to the base;

wherein:

the switch actuator is used to forwardly urge the switch device to place the switch device in a momentary ON position, and rotatably urge the switch device to place the switch device in a constant ON or OFF position.

2. The switch actuator of claim 1, wherein the actuator paddle comprises a horizontally disposed activation surface used to rotatably urge the switch device and an upwards swept ledge used to forwardly urge the switch device.

3. The switch actuator of claim 2, wherein the horizontally disposed activation surface and the upwards swept ledge of the actuator paddle include a plurality of ribs thereon.

4. The switch actuator of claim 2, wherein the base, the actuator paddle, and the actuator arm are a unitary piece.

5. The switch actuator of claim 1, wherein a lateral side of the base is configured to provide a textured surface.

6. A switch actuator used in conjunction with a switch device of a weapon mounted light to selectively actuate a light emitter of the weapon mounted light, the switch actuator comprising:

a base configured for attachment to the switch device;

an actuator paddle offset from and positioned above the base; and an actuator arm connecting the actuator paddle to the base;

wherein:

the actuator paddle comprises a horizontally disposed activation surface used to rotatably urge the switch device to place the switch device in a constant ON position.

7. The switch actuator of claim 6, wherein the actuator paddle further comprises an upwards swept ledge used to forwardly urge the switch device to place the switch device in a momentary ON position.

8. The switch actuator of claim 7, wherein the horizontally disposed activation surface and the upwards swept ledge of the actuator paddle include a plurality of ribs thereon.

9. The switch actuator of claim 7, wherein the base, the actuator paddle, and the actuator arm are a unitary piece.

10. The switch actuator of claim 6, wherein a lateral side of the base is configured to provide a textured surface.

* * * * *